US006568615B2

(12) United States Patent
Klemm

(10) Patent No.: US 6,568,615 B2
(45) Date of Patent: May 27, 2003

(54) HYDRAULIC BREAKER

(76) Inventor: Guenter Klemm, Gray 21, 9572, Deutsch-Griffen (AT)

( * ) Notice: Subject to any disclaimer, the term of this patent is extended or adjusted under 35 U.S.C. 154(b) by 0 days.

(21) Appl. No.: 09/910,042

(22) Filed: Jul. 23, 2001

(65) Prior Publication Data

US 2002/0008169 A1 Jan. 24, 2002

(30) Foreign Application Priority Data

Jul. 22, 2000 (EP) ..... 00 115 805

(51) Int. Cl.[7] ..... B02C 1/02
(52) U.S. Cl. ..... 241/101.73; 241/266
(58) Field of Search ..... 241/101.73, DIG. 38, 241/264, 266, 285.2; 30/134

(56) References Cited

U.S. PATENT DOCUMENTS 3,980,341 A * 9/1976 Musannif et al. ..... 241/101.73
5,273,217 A * 12/1993 Bartels et al. ..... 241/266
5,474,242 A * 12/1995 Rafn ..... 241/101.71

FOREIGN PATENT DOCUMENTS

| | | |
|---|---|---|
| EP | 0 468 871 B1 | 1/1996 |
| JP | 09064760 | 9/1998 |

* cited by examiner

*Primary Examiner*—John M. Husar
(74) *Attorney, Agent, or Firm*—Diller, Ramik & Wight

(57) ABSTRACT

The breaker comprises two breaker jaws (17, 19) adapted to be opened and closed hydraulically, with which building parts, concrete parts, brick walls and the like may be clamped. A hydraulic pulse hammer device (25) is mounted to at least one breaker leg (17), which, by means of a piston (29) strikes on the object in the holding area of the breaker and breaks or splits the same. Thus, the efficiency of the breaker is substantially increased.

7 Claims, 2 Drawing Sheets

HYDRAULIC BREAKER

The Invention refers to a hydraulic breaker comprising two breaking jaws for clamping an object in a holding region.

Hydraulic breakers are known for demolishing buildings, concrete walls, brick walls and the like. Such breakers are mounted to the beam of an excavator and operated to crush and/or grip objects and to move them to a desired location. In contrast to the conventional wrecking balls, breakers have advantages in that they cause less noise and dirt and allow for a controlled demolition, Hydraulic breakers are able to generate great forces of a several tons. However, these forces are often insufficient in particular to crush concrete plates, especially if these contain armoring iron.

To increase the efficiency of breakers, it is known to provide one breaker jaw with a vibratory means that may also have teeth. The object gripped by the teeth is worked on by vibrations in the longitudinal or the transverse direction of the breaker jaws. Breakers featuring hydraulic vibration pistons are described in EP0486871 B1. Here, the vibration pistons are operated by a rotary valve pulse generator via a hydraulic line. The vibratory movements are triggered only when the closing force acting between the breaker jaws has risen to a predetermined adjustable minimum value.

From Patent Abstracts of Japan vol. 1998, No. 14, Dec. 31, 1998 (1998–1231) & JP 10 259670 A (SHIN CATERPILLAR MITSUBISHI LTD.), hydraulic breakers are known that comprise a base member to which a fixed breaker jaw is mounted and to which a movable breaker jaw is articulated. The movable breaker jaw is provided with a pulse hammer device hammering on a tooth bar. The fixed breaker jaw is provided with a fixed tooth bar. Thus, the impacts act from the same direction from which the pressure force is exerted.

It is the object of the present Invention to provide a hydraulic breaker that is able to effectively crush an object it holds so that the largely common tearing and pulling at contiguous objects is largely avoided and the objects can be crushed better and more effectively.

SUMMARY OF THE INVENTION

According to the present invention, a fluid-operated pulse hammer device is provided for striking on an object chucked in the holding area of the breaker, the pulse hammer device forming a unit that is replaceable as a whole and comprises a control device of its own.

In contrast to a vibration means that generally generates sinusoidally increasing and decreasing vibrations, the invention provides for the use of a pulse hammer device that provides sudden and extremely short, strong impact pulses. Such pulse hammer devices are known from rock breakers and stone drilling devices. They comprise a hydraulically movable working piston and a control piston that is also hydraulically movable and is arranged In a control apparatus. The working piston performs a relatively slow return stroke and, after having passed a control edge, is thrust forward at an extremely high speed to strike on an anvil or a counter bearing, Such pulse hammer devices also comprise a gas pressure reservoir wherein energy is gathered during the return stroke that is released suddenly onto the working piston. Using such a pulse hammer device, impacts of very high energy can be dealt, whereby concrete and steel can be crushed so that it is possible to effectively crush the object held between the breaker jaws or to sever the object from a larger area.

The pulse hammer device forms a replaceable unit with an own control device. It can be mounted as a whole and is easy to replace. Thus, it becomes possible to mount a breaker with a pulse tool of the size and impact energy needed for the particular purpose. It is further possible to optionally work with or without the pulse hammer device. Suitably, the pulse hammer device is fixed with bolts in particular between the cheeks or the sidewalls of a breaker jaw.

According to a preferred embodiment of the invention, the pulse hammer device strikes on a striking piece movably guided along one of the breaker jaws. The striking piece is provided with a certain play so that is can be displaced in parallel or be slightly tilted and adapted to the shape of the object clamped. The working piston of the pulse hammer device acts on the striking piece. The movable arrangement of the striking piece also results in the fact that the striking piece can thrust forward for a certain distance when the object yields, whereupon a further closing movement of the breaker follows. Thus, it is prevented that the pulse hammer device that provides a high impact energy strikes a rigid counter bearing of the breaker jaw, whereby the breaker jaw could easily be damaged. Preferably, the striking piece is linearly movable, i.e. vertical to the holding plane. The impacts from the pulse hammer device are thus directed diagonally or vertically against the other breaker jaw.

Another embodiment of the invention provides that the pulse hammer device is mounted to a base member at which the breaker jaws are supported for pivotal movement. The base member Is located in the middle of the holding area of the breaker and it is fixed, whereas both breaker jaws are movable. From this fixed base member, the pulse hammer device acts on the clamped object. The pulse hammer device acts on the bisecting line of the opening angle formed by the clamping surfaces of the breaker. The clamping surfaces have teeth that prevent the clamped object from being pressed out under the action of the pulse hammer device.

The impacts from the pulse hammer device are particularly effective if they act on the object in addition to a strong closing force exerted by the breaker jaws. The closing force should be at least about 100 t and, preferably, in the range from 400 t to 500 t. When this strong closing force is superposed with the impacts, a great crushing capability is obtained.

Further, it is suitable to provide a plurality of pulse hammer devices side by side on one breaker jaw, which are operated either synchronously or asynchronously. A carrier apparatus (excavator) usually has high hydraulic power. Since the carries apparatus stands still during the breaker's work and consumes no hydraulic power, there is sufficient energy available for a plurality of pulse hammer devices that work on different places.

BRIEF DESCRIPTION OF THE DRAWING

The following is a detailed description of an embodiment of the invention with reference to the accompanying drawings.

In the figures.

DESCRIPTION OF A PREFERRED EMBODIMENT OF THE INVENTION

Figure 1:
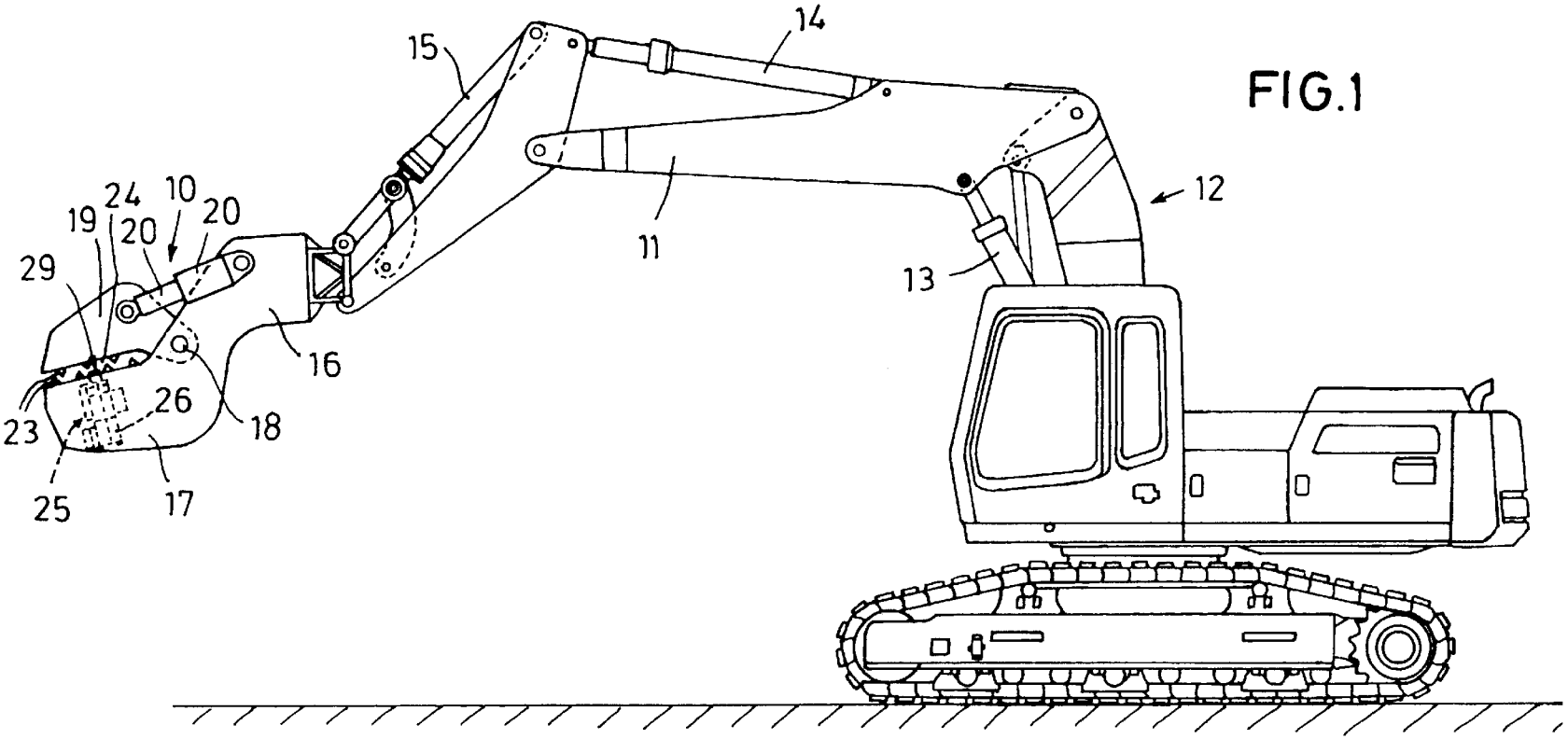
FIG. 1 is a side elevational view of an excavator provided with a hydraulic breaker.
Figure 2:
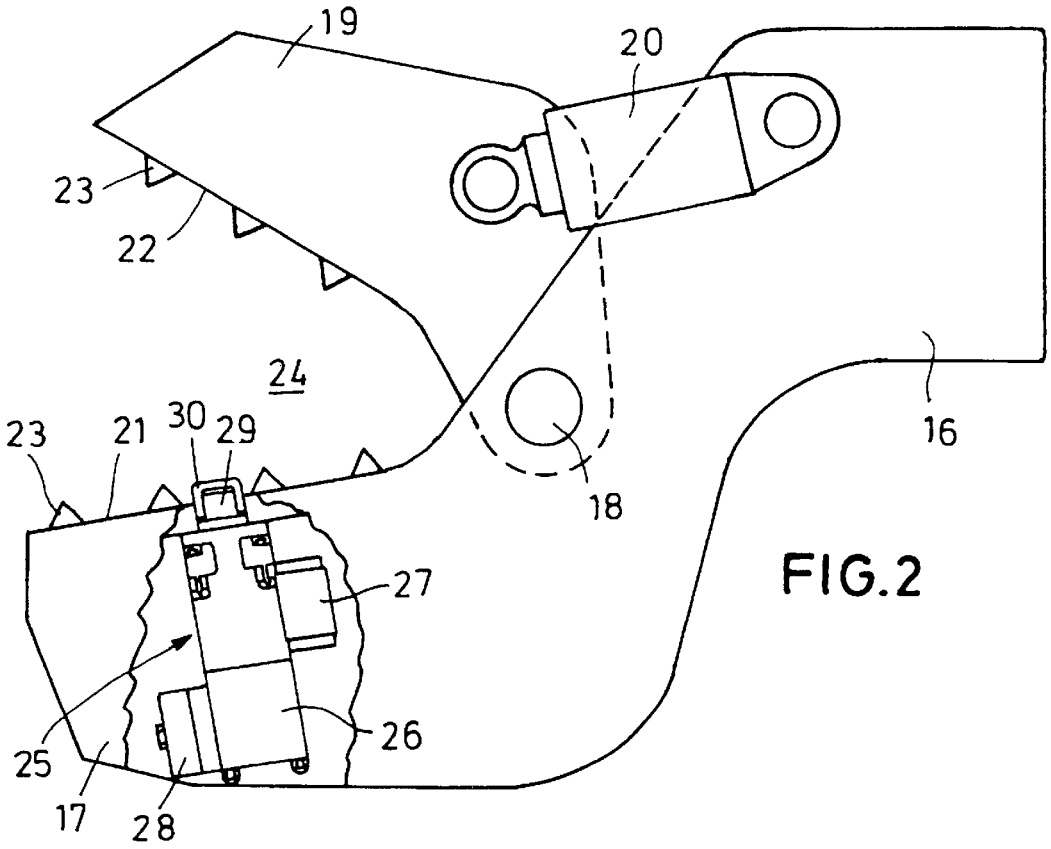
FIG. 2 is an enlarged view of the breaker of FIG. 1.

Referring to FIG. 1, the breaker 10 is mounted to the beam 11 of a movable excavator 12. The beam 11 comprises hydraulic cylinders 13, 14, 15 that move the different beam sections to guide the breaker 10.

The breaker 10 comprises a base member 16 engaged by the beam 11, from which an immobile fixed breaker jaw 17 projects. At the lower breaker jaw 17, an upper breaker jaw 19 is fixed by a joint 18, the jaw 19 being pivoted about the joint 18 by a hydraulic cylinder 20. Both breaker jaws 17 and 19 have projecting pointed teeth 23 on their opposing clamping surfaces 21 and 22, which claw into the object to be clamped. The holding area 24 is situated between the clamping surfaces 21 and 22.

A fluid-operated pulse hammer device 25 is mounted to the fixed breaker jaw 17 and is directed towards the holding area 24. The pulse hammer device comprises an elongate hammer housing 26 provided with a control 27 and a gas pressure reservoir 26. The pulse hammer device 25 further has a piston 29 protruding from the housing 26 and moved hydraulically to and fro in the axial direction. The piston 29 has its end provided with a tool member 30 which is an abrasion-resistant impact tip or a blade. Upon operation of the pulse hammer device, the tool member 30 penetrates into the object held and breaks the same.

In the above described embodiment, the pulse hammer device has a manually adjustable activating device with which it can optionally be turned on and off. The pulse impact device may also be equipped with an automatic activating device that turns on the pulse hammer tool as a function of the pressure of the hydraulic actuating means, i.e. the cylinders 20. However, this activation should only occur when the breaker jaws are not In the closed position, i.e. when an object is clamped therebetween. To achieve this, a sensor ma be provided for detecting the closed position of the breaker jaws, the sensor allowing the activating device to be turned on only when the breaker jaws are not in the closed position.

What is claimed is:

1. A hydraulic breaker comprising a base member (16) adapted for mounting to a beam (11) of a movable excavator (12), said base member including an immobile fixed breaker jaw (17), a movable breaker jaw (19), said breaker jaws (17, 19) defining therebetween a holding area (24) within which an object can be clamped in a first closed position of said breaker jaws (17, 19), means (18) movably connecting said movable breaker jaw (19) to said base member (16), hydraulic actuating means (20) for moving said movable breaker jaw (19) between said first closed position and a second open position, a fluid operated pulse hammer device (25) defining a replacement unit assembled to and disassembled from said immobile fixed breaker jaw (17) as a whole, and control means (27) for selectively operating said pulse hammer device (25) when said movable breaker jaw (19) is in said first closed position for impacting against an object in said holding area (24).

2. The hydraulic breaker as defined in claim 1 wherein said movable breaker jaw (19) is devoid of a pulse hammer device.

3. The hydraulic breaker as defined in claim 2 including means responsive to fluid pressure of said hydraulic actuating means (20) for initiating the operation of said control means (27) to operate said pulse hammer device (25) in the first closed position of said breaker jaws (17, 19).

4. The hydraulic breaker as defined in claim 2 including means responsive to fluid pressure of said hydraulic actuating means (20) for initiating the operation of said control means (27) to operate said pulse hammer device (25) in the first closed position of said breaker jaws (17, 19), and means for detecting the first closed position of said breaker jaws (17, 19).

5. The hydraulic breaker as defined in claim 1 wherein said control means (27) is manually activated.

6. The hydraulic breaker as defined in claim 1 including means responsive to fluid pressure of said hydraulic actuating means (20) for initiating the operation of said control means (27) to operate said pulse hammer device (25) in the first closed position of said breaker jaws (17, 19).

7. The hydraulic breaker as defined in claim 1 including means responsive to fluid pressure of said hydraulic actuating means (20) for initiating the operation of said control means (27) to operate said pulse hammer device (25) in the first closed position of said breaker jaws (17, 19), and means for detecting the first closed position of said breaker jaws (17, 19).

* * * * *